US006311367B1

(12) United States Patent
Larsen

(10) Patent No.: US 6,311,367 B1
(45) Date of Patent: Nov. 6, 2001

(54) APPARATUS AND METHOD FOR SUPPORTING A DOOR IN AN OPEN POSITION

(76) Inventor: Kenneth Duane Larsen, 10750 Rockford Rd., Plymouth, MN (US) 55442

( * ) Notice: Subject to any disclaimer, the term of this patent is extended or adjusted under 35 U.S.C. 154(b) by 0 days.

(21) Appl. No.: 09/532,480

(22) Filed: Mar. 22, 2000

(51) Int. Cl.[7] ..... E05D 11/10

(52) U.S. Cl. ..... 16/375; 16/82; 292/DIG. 15; 292/291

(58) Field of Search ..... 16/375, 374, 82, 16/343, 344; 292/DIG. 15, 288, 291

(56) References Cited

U.S. PATENT DOCUMENTS

D. 439,832 * 4/2001 Crooks et al. ..... 16/82
3,620,483 * 11/1971 Weinberger ..... 16/82
3,758,141 * 9/1973 Weinberger ..... 16/82
4,756,052 7/1988 Diedrich .
4,813,100 3/1989 King .
5,335,396 8/1994 Dolan .
6,149,212 * 11/2000 Kuntz et al. ..... 16/82

* cited by examiner

*Primary Examiner*—Lynne H. Browne
*Assistant Examiner*—Doug Hutton
(74) *Attorney, Agent, or Firm*—Michael A. Mochinski

(57) ABSTRACT

A door support for holding open a door equipped with a hydraulic-type closure having a pair of closure arms and a hydraulic element comprises first and second channel members, each having a top side, a hinged wall and latching wall, with both walls spaced apart and extending perpendicular from the top side, forming a generally rectangular configuration. A hinge, which is fixedly attached to the hinged walls of the first and second channel members, permits rotation of the channel members about the longitudinal axis thereof for alignment of the channel members with that of the selective positioning of the closure arms. An elongate, flexible band, having a latching end and a secured end, and a bolt or cylindrical, elongate pin positioned through the apertures of the latching end and latching wall of the second channel member secures or locks the channel members in a stationary position to prevent lateral movement of the closure arms.

20 Claims, 5 Drawing Sheets

APPARATUS AND METHOD FOR SUPPORTING A DOOR IN AN OPEN POSITION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a door support and method for holding open a door equipped with a hydraulic-type closure having a pair of arms. More particularly, the present invention relates to a new and improved door support having a pair of adjustable channels which are conveniently and easily mounted over and dismounted from the arms of the door closure.

BACKGROUND OF THE INVENTION

The utilization of doorstops and the alike are well known in the art. However, most, if not all, do not allow a user to readily and conveniently mount and dismount the support from the closure arms. Today, many office buildings and other commercial structures are constructed with large, heavy doors having large panels of glass or metal. In some cases, these types of doors are equipped with hydraulic-type closures to control or limit how fast or slow the door closes. Generally, these types of doors can be found at the main entrance, at emergency exits, and at the shipping entrance. Due to the heavy weight and type of construction, these types of doors can be difficult to support in an open position for prolonged periods of time, such as in the case when it is desired to transport heavy packages, furniture and large objects in and out of the main entryway or to clean at or near the door's threshold.

In some instances, the door is propped open using a built-in door stop, which is generally located at or near the bottom of the door or made part of the door closure unit by the manufacturer. Unfortunately, these types of doorstops fail or become out of adjustment over an extended period of time through frequent use. Additionally, certain fire codes prohibit the use of door-open devices that are permanently attached to the door or door hinge by the user as they can prevent the door from being shut or opened quickly during an emergency. While there are certain recognizable problems in the field using such devices, maintenance or delivery personnel may overcome the foregoing problems by inserting a portable, wedge-like device in between the floor and the bottom of the door, or may insert an object, not necessarily dedicated as a door-open device, in between the doorjamb and door, near the door's hinge, which can cause long-term damage to the door and door jamb. Although the wedge-like doorstop may work on some occasions, it may not on other occasions due to the device's tendency to slip about the floor's surface, particularly if it is waxed and/or if the door is jarred from its stationary position. Moreover, a wedge-like doorstop can be easily misplaced or prevent adequate cleaning at or near the door's threshold.

Accordingly, there still remains the need for a door support that is capable of holding a door in an open position at any desired angle as well as allowing for convenient storage on the user. The door support should be relatively inexpensive to manufacture, simple in design, easily placed into position and removed, and not be subject to damage through proper use. The present invention is directed to the foregoing needs as well as to others as explained and described in the following sections.

BRIEF SUMMARY OF THE INVENTION

It is therefore an object of the present invention to provide a new and improved door support which can be safely and easily placed over and removed from the arms of the door closure.

It is also an object of the present invention to provide a new and improved door support which is simple in construction and inexpensive to manufacture.

It is another object of the present invention to provide a new and improved door support which is capable of holding open a door for a prolonged period of time.

It is yet another object of the present invention to provide a new and improved door support which may be easily and efficiently manufactured and marketed.

An even further object of the present invention to provide a new and improved door support which is of durable and reliable construction.

To achieve these objects, and others, the present invention essentially comprises a new and improved door support for holding open a door equipped with a hydraulic-type door closure having a pair of arms, such invention comprising, in combination: first and second channel members, each having a top side, a hinged wall and latching wall, with both walls extending perpendicular from the top side; a hinge; and an elongate, flexible band equipped with an aperture at one of its ends for passage of a cylindrical pin or threaded bolt. In operation, the channels are placed over the closure arms until the top sides of the first and second channel members completely rests atop of the closure arms. This positioning locks and prevents lateral movement of the closure arms. The extent to which the door is opened is made possible by the adjustable band, which includes an aperture that matches up or aligns to the threaded apertures of the latching wall of the second channel member.

The present invention is particularly advantageous for use with a door equipped with a hydraulic-type door closure having a pair of arms that are separated by a hinge. These advantages are very important to the average delivery person or maintenance personnel interested in economical and useful improvement to holding open a door equipped with a hydraulic-type closure.

There has been described, rather broadly, the more important features of the present invention in order that the detailed description thereof that follows may be better understood, and in order that the present contribution to the art may be better appreciated.

It is understood that the present invention is not limited in its application to the details of construction and the arrangements of the components set forth in the following description or illustrated in the drawings. The present invention is capable of other embodiments and of being practiced and carried out in several ways. Further, it is to be understood that the phraseology and terminology employed herein are for the purpose of description and should not be regarded as limiting the scope of the present invention.

The foregoing objects of the present invention, combined with the various features of novelty which characterize the present invention, are pointed out with particularly in the claims annexed to and forming a part of this disclosure. For a greater understanding of the present invention, reference should be made to the accompanying drawings and descriptive matter in which there is illustrated the preferred embodiment of the present invention.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

Figure 1:
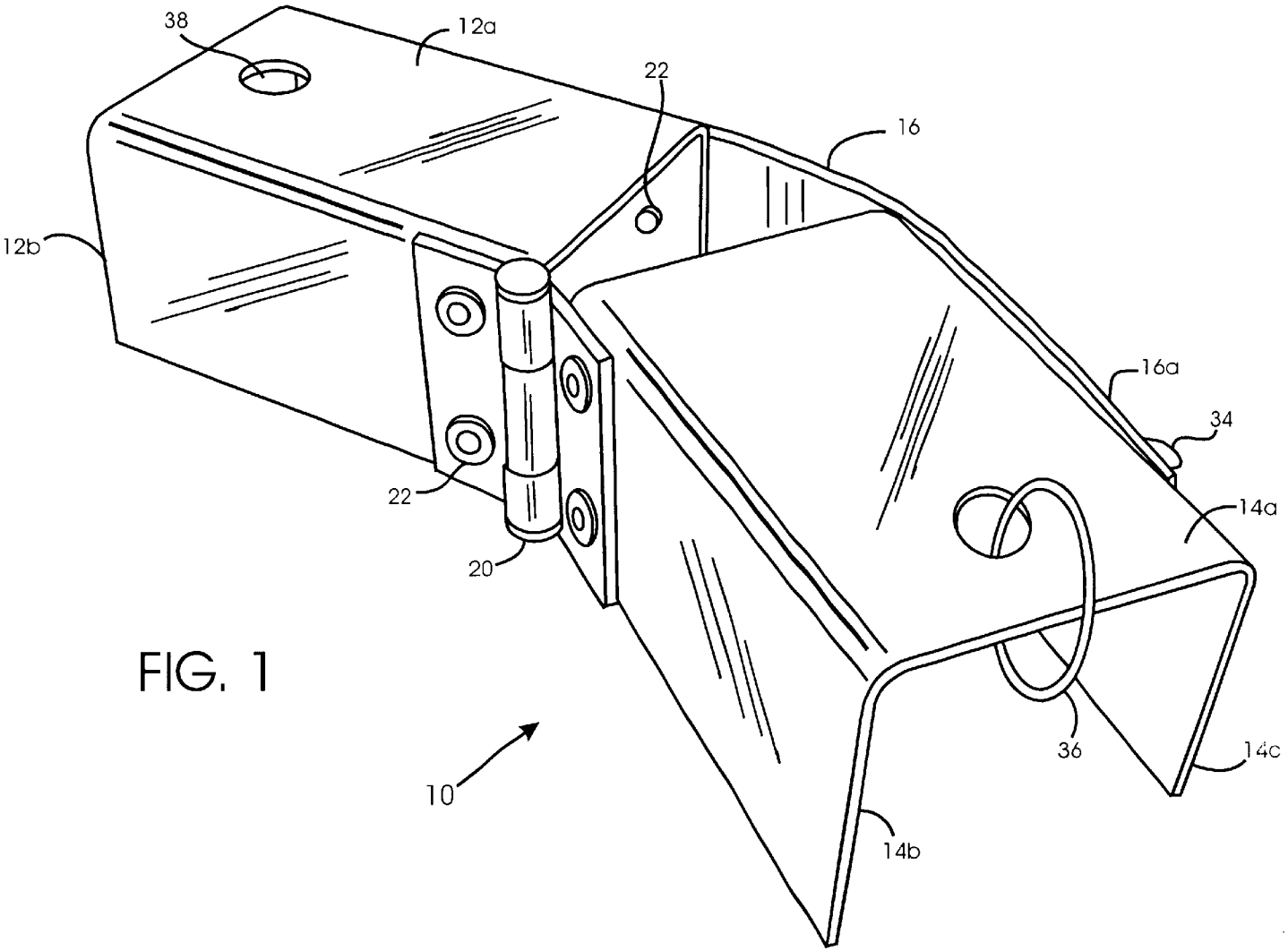
FIG. 1 is a perspective view of the preferred embodiment of the door support constructed in accordance with the principles of the present invention.

While this invention is susceptible of being embodied in many different forms, preferred embodiment of the invention is shown in the drawings and described in detail hereinafter with the understanding that the present disclosure is to be considered to exemplify the principles of the present invention and is not intended to limit the invention to the embodiment illustrated.

With reference to the drawings, and in particular, to FIG. 1 thereof, the preferred embodiment of the new and improved door support embodying the principles concepts of the present invention and generally designated by the reference number 10 will described hereinafter.

In its broadest context, the present invention consists of first 12 and second 14 channel members; means to rotatably connect the first and second channel members about the longitudinal axis thereof; an elongate, flexible band 16 having a latching end 16*a* and a secured end 16*b,* the secured end being fixedly attached to the first channel member; and means to fixedly attach the latching end to the second channel member. Such components are individually configured with respect to each other so as to achieve the desired objectives.

In the preferred embodiment, the first 12 and second 14 channel members each include a top side 12*a,* 14*a,* a hinged wall 12*b,* 14*b* and a latching wall 12*c,* 14*c,* with both walls extending perpendicular from the top side of each of the channel members, respectively. The hinged and latching walls are positioned to run parallel to one another and are spaced apart to permit adequate fitting atop of a pair of closure arms. The positioning of the channel members over the closure arms makes it possible to limit travel or lateral movement of the closure arms, resulting in a door being held in an open position for any length of time. The latching wall of the second channel member includes a plurality of apertures 18, which arc preferably threaded and equally spaced apart from one another. The channels members, as well as the hinged and latching walls, are fabricated from metal, such as galvanized steel, or high strength plastic, such as polyvinyl chloride (PVC), and are preferably formed in a generally rectangular configuration; however, other geometric configurations are equally suitable, providing that each of the channel members is shaped to fit tightly over and around each of the closure arms.

Figure 2:
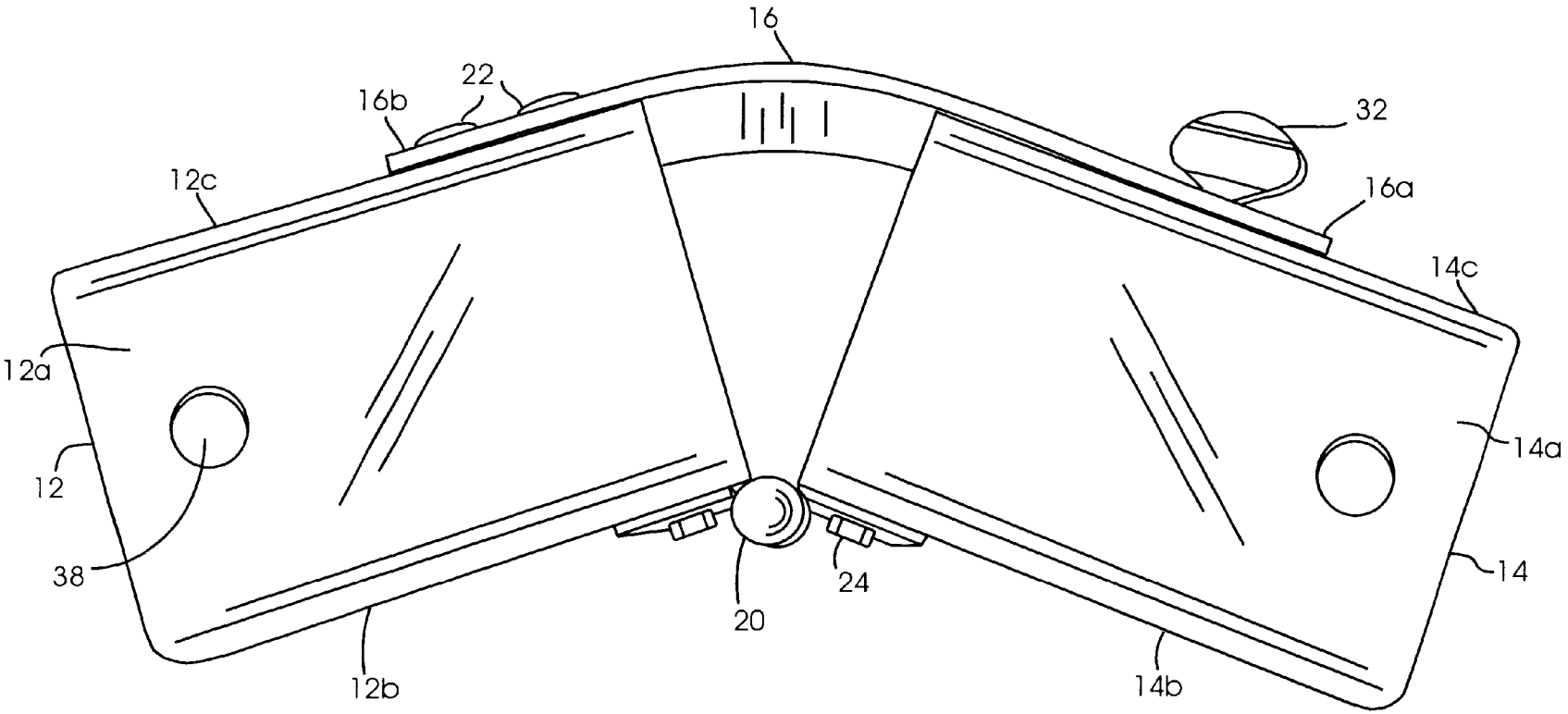
FIG. 2 is a top view of the preferred embodiment of the door support.
Figure 4:
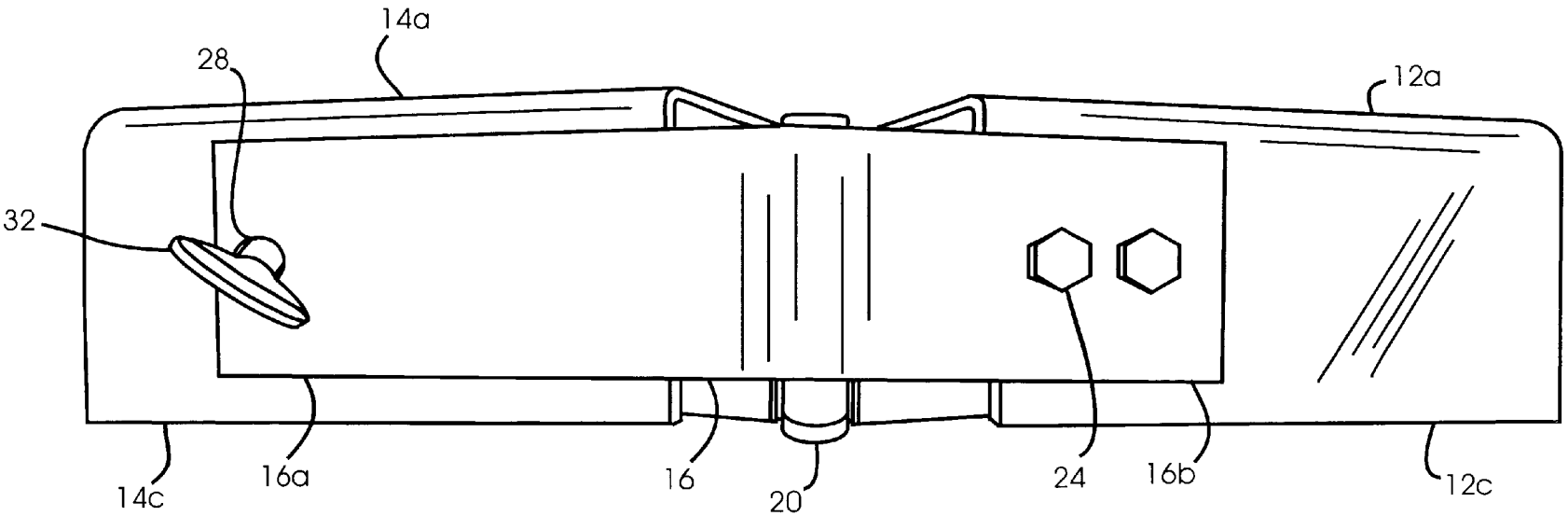
FIG. 4 is a side view of the preferred embodiment of the door support.

Referring now to FIGS. 2 and 4, the rotatably connect means preferably includes a hinge 20 which is fixedly attached to the hinged walls of the first and second channel members using a plurality of rivets 22, bolts 24 or other fastening devices that are presently known in the art. Similarly, the secured end 16*b* of the elongate, flexible band is fixedly attached to the latching wall of the first channel member using rivets 22 or bolts 24 that protrude therethrough. The other end of the elongate, flexible band 16, referred to as the latching end 16*a,* includes an aperture 26 to permit passage of a threaded bolt 28 for locking or securing the first and second channel members in a desired position. It is preferred that the elongate, flexible band be fabricated from metal, such as galvanized metal, or similar type of material that is capable of being formed in an arcuate shape and withstanding tensile forces.

Figure 3:
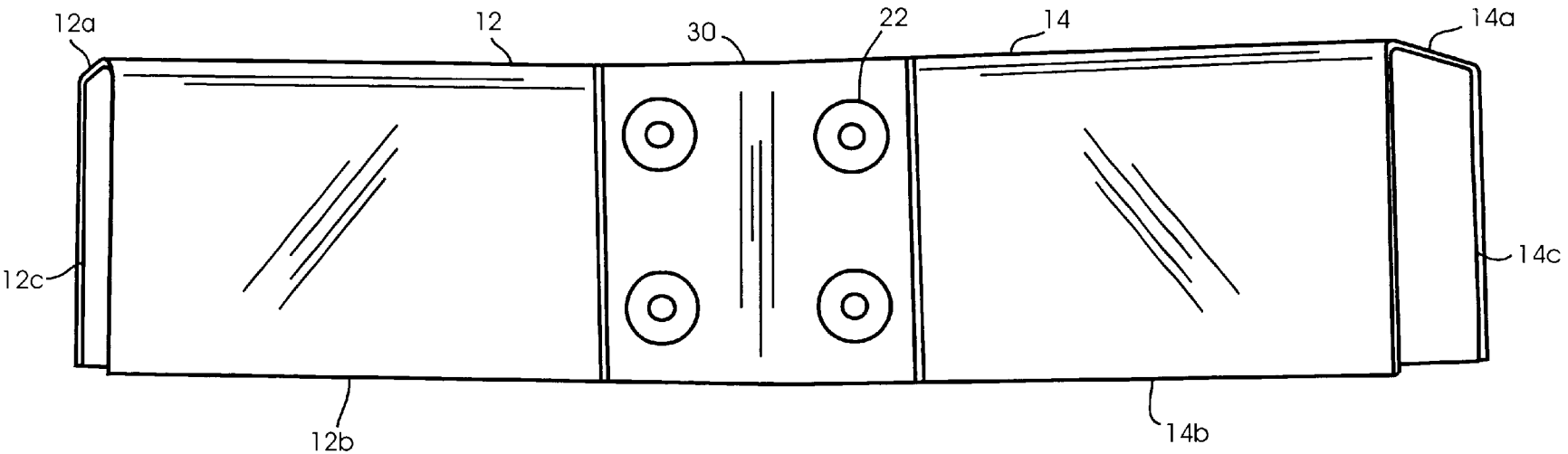
FIG. 3 is a side view of the preferred embodiment of the door support.

As an alternative, the rotatably connect means may include a strap 30 made from pliable high strength materials, such as PVC, or other suitable material capable of withstanding breakage which may occur as a result of the persistent back-and-forth, lateral motion of the first and second channel members. Note FIG. 3.

As can be seen in FIG. 4, the threaded bolt 28 includes grasping means 32 at one of its ends, preferably shaped into a flat configuration, so as to permit hand tightening of the bolt. Alternatively, an elongate pin 34, formed in generally cylindrical configuration, can be used to lock or secure the latching end of the flexible band to the latching wall of the second channel member, providing its diameter is slightly smaller in size than the apertures located at the latching wall 14*c* of the second channel member. It is preferable to shape the pin's end into a generally flat configuration, similar to the configuration previously described for the threaded bolt, so as to allow for convenient removal and insertion of the pin without hand tools.

Figure 5:
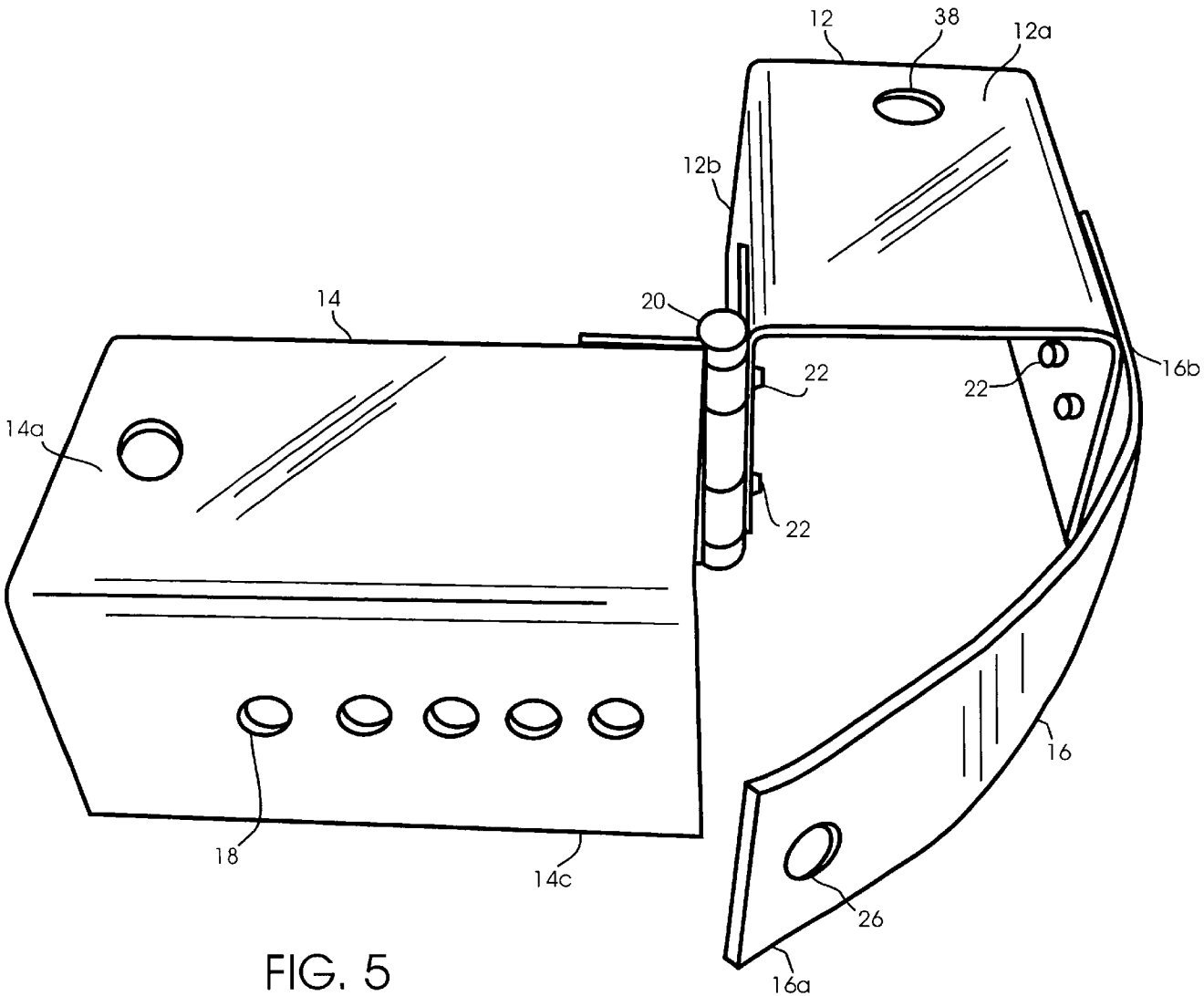
FIG. 5 is a perspective view of the preferred embodiment of the door support.

In an operative orientation, a user removes the cylindrical pin or threaded bolt from the latching wall 14*c* of the second channel member 14 to permit selective positioning of the channel members relative to the position of the closure arms. Once the closure arms and channels members are at their desired position, the user positions and aligns the aperture at the latching end 16*a* with one of the apertures located at the latching wall of the second channel member and re-inserts the pin or bolt therein to lock the first 12 and second 14 channel members in a stationary position. After configuring the channel members to their desired position, the user simply fits the channel members over the two closure arms, making sure that the top sides 12*a,* 14*a* of the first and second channel members 12, 14 completely rest atop of the closure arms. This positioning mitigates the chances of having the channel members inadvertently releasing from the closure arms, since the closure arms will have a tendency to compress or come together laterally due to the presence of a hydraulic mechanism or element in the door closure. Note FIG. 5.

Removal of the channel members is simply accomplished by relieving the pressure of the closure arms on the hinged and latching walls of the first and second channel members, which can be achieved by slight movement of the door beyond the selective open position. Once the pressure is eliminated from the hinged and latching walls, the first and second channel members are simply lifted from the top, away from the closure arms. A ring-like member 36 fitted to an aperture 38, of which is located on each of the top sides of the first and second channel members, provides a means for convenient storage of the door support on the user's belt or belt loop.

As to the manner of usage and operation of the present invention, the same should be apparent from the description as described above. Accordingly, no further discussion relating to the manner and method of usage and operation will be included herein.

With respect to the above description then, it is to be realized that the optimum dimensional relationships for the parts of the present invention, to include variation in size, shape, materials, form, function, and the manner and method of operation, assembly and use, are deemed readily apparent and obvious to one skilled in the art, and all the equivalent relationships to those illustrated in the drawings and described in the specification are intended to be encompassed by the present invention.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. A door support for holding open a door equipped with a hydraulic-type closure having a pair of arms and a hydraulic element, said support comprising:

first and second channel members, each having a top side, a hinged wall and latching wall extending perpendicular from said top side;

means to rotatably connecting said hinged walls of first and second channel members about the longitudinal axis of said rotatably connect means;

an elongate, flexible band having a latching end and a secured end, said secured end being fixedly attached to said latching wall of first channel member; and means to fixedly attach said latching end to said latching wall of second channel member.

2. A door support as set forth in claim 1, wherein said first and second channel members are formed in a geometric configuration to fit over and around the closure arms.

3. A door support as set forth in claim 1, wherein said latching wall of second channel member further comprises a plurality of apertures spaced equally apart.

4. A door support as set forth in claim 3, wherein said apertures of latching wall of second channel member are threaded.

5. A door support as set forth in claim 1, wherein said top sides of first and second channel members include an aperture for placement of a ring-like member to support said channel members on a user.

6. A door support as set forth in claim 1, said fixedly attaching means includes an aperture to permit passage of a threaded bolt for adjusting said latching end about said latching wall of second channel member, said threaded bolt being positioned to extend through an aperture of latching wall of second channel member and said aperture of latching end.

7. A door support as set forth in claim 1, wherein said flexible band is arcuately shaped to conform to the positioning of said first and second channel members.

8. A door support as set forth in claim 6, wherein said bolt further comprises an end having a flat, molded shape to permit hand rotation of said bolt about the longitudinal axis thereof.

9. A door support as set forth in claim 1, said rotatably connecting means comprises a hinge fixedly attached to said hinged walls of first and second channel members.

10. A door support as set forth in claim 1, wherein said secured end is fixedly attached to said latching wall of first channel member by a plurality of rivets protruding through said secured end and said latching wall of first channel member.

11. A door support as set forth in claim 1, wherein said secured end is fixedly attached to said latching wall of first channel member by a plurality of bolts protruding through said secured end and said latching wall of first channel member.

12. A door support comprising:

first and second channel members, each having a top side, a hinged wall and latching wall extending perpendicular from said top side, said latching wall of second channel member having a plurality of threaded apertures;

a hinge fixedly attached to said hinged walls of first and second channel members to permit rotation of said channel members about the longitudinal axis of said hinge;

an elongate, flexible band having a latching end and a secured end, said secured end being fixedly attached to said latching wall of first channel member; and a threaded bolt extending through an aperture of latching end and said threaded aperture of latching wall of second channel member to secure and permit adjustment of said first and second channel members.

13. A door support as set forth in claim 12, wherein said hinge is fixedly attached to said hinged walls of first and second channel members by a plurality of rivets.

14. A door support as set forth in claim 12, wherein said band is fabricated from metal and formed in a generally arcuate configuration.

15. A method of supporting a door in an open position, the door being equipped with a hydraulic-type closure having a pair of arms, the method comprising the steps of:

providing a door support having first and second channel members, each having a top side, a hinged wall and latching wall extending perpendicular from said top side, said latching wall of second channel member having a plurality of threaded apertures; a hinge fixedly attached to said hinged walls of first and second channel members to permit rotation of channel members about the longitudinal axis of said hinge; an elongate, flexible band having a latching end and a secured end, said secured end being fixedly attached to said latching wall of first channel member, said latching end having a non-threaded aperture; and a threaded bolt extending through said aperture of latching end and said threaded aperture of latching wall of second channel member to secure and permit adjustment of said first and second channel members;

selectively aligning said aperture of said latching wall of second channel member with that of said aperture of latching end to achieve a desired open position of said first and second channel members;

inserting said threaded bolt into said aligned apertures to lock said first and second channel members in a stationary position; and positioning said first and second channel members over the closure arms.

16. A door support for holding open a door equipped with a hydraulic-type closure having a pair arms, said support comprising:

first and second channel members, each having a top side, a hinged wall and latching wall extending perpendicular from said top side, forming a generally rectangular configuration, said latching wall of second channel member having a plurality of apertures;

a flexible strap fixedly attached to said hinged walls of first and second channel members to premit free, swinging movement of said first and second channel members;

an elongate, flexible band having a latching end and a secured end, said secured end being fixedly attached to said latching wall of first channel member; and an elongate pin extending through an aperture of latching end and one of said apertures of latching wall of second channel member to secure and permit adjustment of said first and second channel members.

17. A door support as set forth in claim 16, wherein said strap is fabricated from a pliable material and is fixedly attached to said hinged walls of first and second channel members by a plurality of rivets.

18. A door support as set forth in claim 16, wherein said pin is formed in a generally cylindrical configuration.

19. A door Support as set forth in claim 16, wherein said pin comprises grasping means to permit hand rotation of said pin about the longitudinal axis thereof and to allow insertion and removal of said pin from said aperture of latching wall of second channel member and said aperture of latching end.

20. A door support as set forth in claim 16, wherein said top sides of first and second channel members each have an aperture for placement of a ring-like member to support said first and second channel members on a user's belt or belt loop.

* * * * *